US005513845A

United States Patent [19]

Sonagere

[11] Patent Number: 5,513,845

[45] Date of Patent: May 7, 1996

[54] GOLF PUTTER

[76] Inventor: Henry Sonagere, 5040 SE. Burning Tree Cir., Stuart, Fla. 34997

[21] Appl. No.: 455,733

[22] Filed: May 31, 1995

[51] Int. Cl.[6] ..... A63B 53/16

[52] U.S. Cl. ..... 473/206; 473/201; 473/251; 473/295

[58] Field of Search ..... 273/187.5, 81.2, 273/81.3, 81.4, 165, 81 B, 81 C, 81 D, 73 J, 75, 81 R, 80 R; 15/144.1, 144.2

[56] References Cited

U.S. PATENT DOCUMENTS

| | | | |
|---|---|---|---|
| 1,305,952 | 6/1919 | Suesman . | |
| 1,544,226 | 6/1925 | De Sus . | |
| 1,677,099 | 7/1928 | Harness | 273/81 B |
| 2,044,567 | 6/1936 | Daday . | |
| 2,225,839 | 12/1940 | Moore . | |
| 2,619,368 | 11/1952 | Anderson . | |
| 2,877,018 | 3/1959 | Turner | 273/81 B |
| 3,534,960 | 10/1970 | Hanks | 273/75 |
| 3,706,453 | 12/1972 | Rosasco | 273/81 B |
| 3,804,413 | 4/1974 | Hrivnak . | |
| 3,834,714 | 9/1974 | Smolinski . | |
| 4,065,127 | 12/1977 | Fagan | 273/81 D |
| 4,101,125 | 7/1978 | Heath . | |
| 4,163,554 | 8/1979 | Bernhardt | 273/81 B |
| 4,365,807 | 12/1982 | Melby . | |
| 4,679,791 | 7/1987 | Hull | 273/81 B |

*Primary Examiner*—Sebastiano Passaniti
*Attorney, Agent, or Firm*—Dykema Gossett

[57] ABSTRACT

The invention relates to a putter grip assembly including a partially threaded sleeve provided with a threaded retaining nut at the base of the sleeve. This will permit a golfer to slide the putter grip assembly including the sleeve over the shaft of the putter after having first removed the existing putter grip. Thereafter the golfer rotationally adjusts the angle of the grip to the putter face to various positions until the golfer finds the angle that works best for his/her putting stroke. The golfer then tightens the nut on the sleeve to fix the angle of the hand grip with reference to the putter face. Once the golfer has identified the best grip-face angle for his/her putting stroke, a plastic sealant such as epoxy resin is provided between the retaining nut, sleeve and shaft thereby immobilizing the retaining nut and fixedly connecting the hand grip assembly to the shaft.

13 Claims, 2 Drawing Sheets

GOLF PUTTER

BACKGROUND OF THE INVENTION

1. Field of the Invention

The implement disclosed herein is a sporting goods implement, namely a golf putter used in the game of golf.

2. Description of Prior Art

It has been known for some time that the grip of a golfer on the golf putter when addressing a golf ball plays a very important part in the accuracy of the putt and in the skill of the golfer. It is further well known that a conventional golf putter is provided with elongated shaft having a head defining a flat putter face on one end and a hand grip of customary length sleeved on the other end of the shaft. With such construction the grip is made from a resilient material and is provided with a flat spot on one side thereof which is normally located at a 90° angle to the putter face provided on the head.

It is further well known that many "senior" golfers, men and women alike, have arthritic conditions whereby the hands and fingers of the golfers are deformed. Thus, it has been found that the location of the 90° angle between the flat spot provided on the hand grip and the flat putter face is not acceptable to many persons who suffer from arthritis in the hands and fingers.

In the past, a golfer suffering from arthritis will take suitable medication in order to attempt to relieve the symptoms of arthritis; however, as the arthritic condition becomes more acute, it is difficult for the golfer to properly grip the conventional golf putter having the conventional hand grip located as previously described. As a consequence, the golfer afflicted with arthritis or other deformities of the hands and fingers will not putt as well on the greens thereby creating for the golfer internal tension and stress.

The United States Golf Association (U.S.G.A.) has approved grips for putters which are all designed with one flat surface that is normally positioned with the flat surface of the grip perpendicular to the face of the putter. The grip is glued or fixed in this position and cannot be moved or adjusted without destroying the grip. The U.S.G.A. rules prohibit the use of an adjustable putter grip on a golf putter during play. Thus there must be some accommodation provided between the U.S.G.A. rules of golf and the rules for golf putters and the difficulty which golfers find themselves when subjected to arthritis or other deformities of the hands and fingers.

SUMMARY OF THE PRESENT INVENTION

The present invention relates to the mounting of a standard putter grip on a partially threaded sleeve provided with a threaded retaining nut at the base of the sleeve. This will permit a golfer to slide the putter grip and sleeve over the shaft of the putter after having first removed the existing putter grip. Thereafter the golfer rotationally adjusts the angle of the grip to the putter face to various positions until the golfer finds the angle that works best for his/her putting stroke. The golfer then tightens the nut on the sleeve to fix the angle of the hand grip with reference to the putter face. Once the golfer has identified the best grip-face angle for his/her putting stroke, a plastic sealant such as epoxy resin is provided between the retaining nut, sleeve and shaft thereby immobilizing the retaining nut and fixedly connecting the hand grip assembly to the shaft thereby complying with the rules of the United States Golf Association.

DETAILED DESCRIPTION OF THE PREFERRED EMBODIMENT

Figure 1:
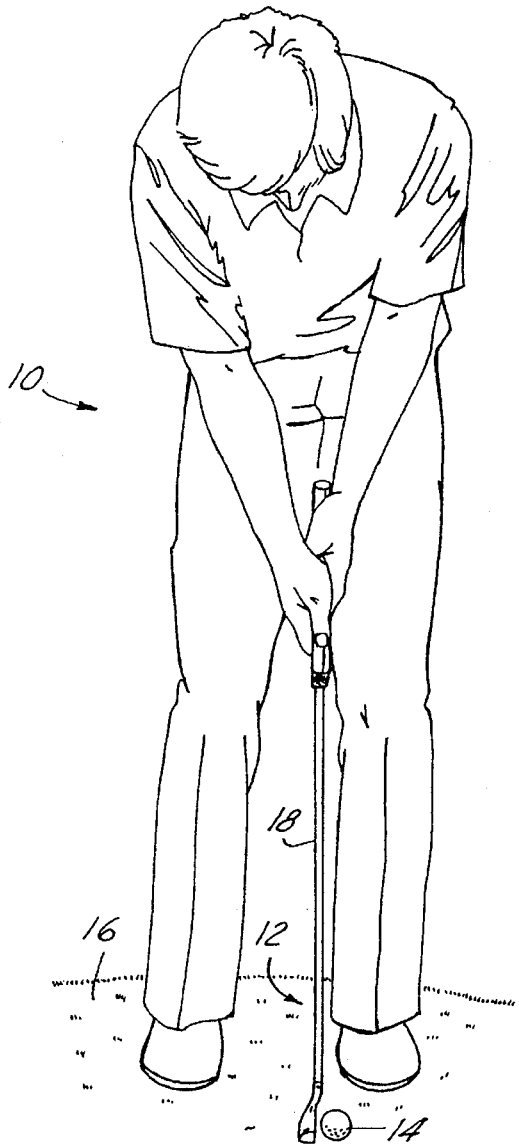
FIG. 1 is a perspective view illustrating a golfer with a putter addressing the golf ball prior to putting.
Figure 2:
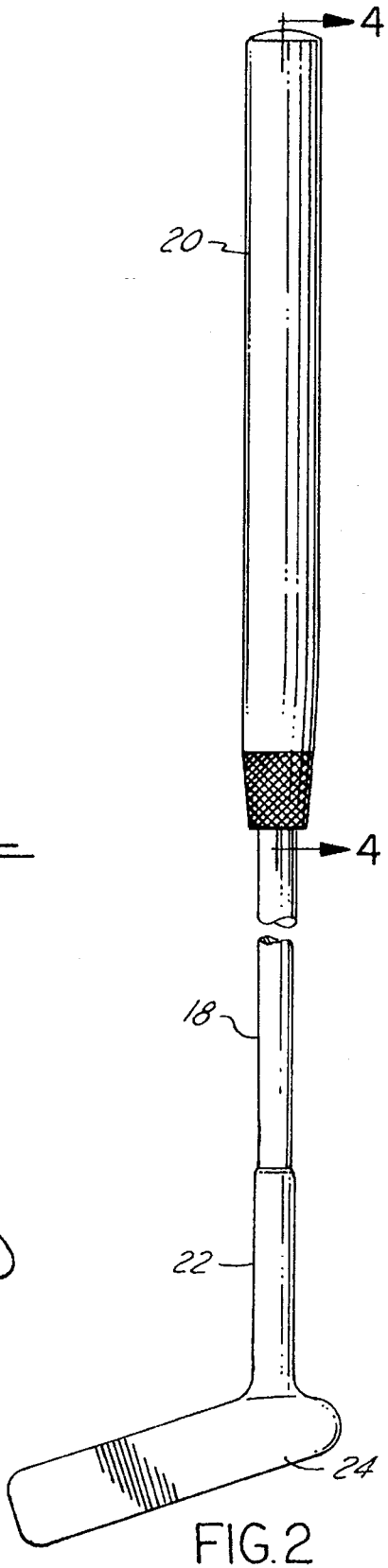
FIG. 2 is a front elevational view of the golf putter.

Referring now to the drawings, FIG. 1 illustrates a golfer 10 holding a golf putter 12 and addressing the golf ball 14 on the green 16. The golf putter 12 has the usual shaft 18 which is either straight as in FIG. 4 or tapered as in FIG. 6 as is the custom in making such shafts whether they are made of steel, aluminum, fiberglass or from other engineered materials.

The shaft 18 has an upper end which is provided with the customary hand grip 20. The lower end of shaft 18 is fixedly connected to the usual hosel 22 for joining the putter head 24 to the shaft 18. The putter head 24 has a generally flat putter face 26. Putter face 26 lies in a plane which is normally located at 90° to the plane containing the generally flat spot or surface 28 provided on the hand grip 20 as in well known in the art. Such a conventional arrangement of 90° between the putter face 26 and the hand grip flat surface 28 does not assist a golfer, who is subjected to arthritic hands and fingers, in improving his/her putting skills. With the prior art construction the golfer addresses the ball 14 with the putter 12 and strikes the ball; however, the ball is stoked either to the left or to the right of the hole due to the arthritic conditions of the hands and fingers.

Figure 3A:
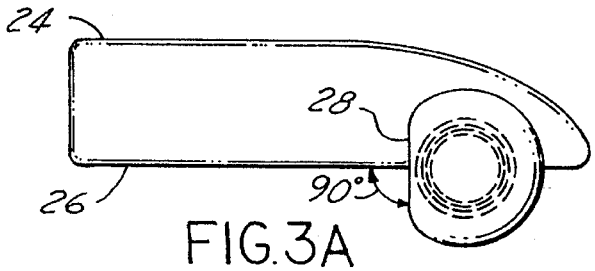
FIG. 3A is a top view of a conventional golf putter illustrating the 90° relationship between the flat spot provided on the hand grip and the face of the golf putter.
Figure 3B:
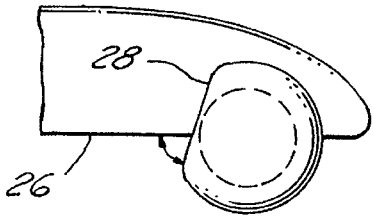
FIG. 3B illustrates a top view of a modified golf putter according to the present invention illustrating the angular relationship between the flat spot on the hand grip and the flat putter face.

In order to compensate for such arthritic conditions, the present invention permits the golfer to customize the hand grip assembly on the shaft to compensate for the arthritic or deformed fingers and hands of the golfer. Thus, the golfer may select the angle between the putter face 26 and the flat face 28 to be greater than 90° or less than 90° as shown in FIG. 3B. In fact, the angle may be anywhere between 0° and 360° except for a 90° angle. In one instance it has been found that a 40° angle between the putter face 26 and the flat spot 28 is acceptable and compensates for the arthritic condition of the hands and fingers of the golfer. In another instance it has been found that setting the angle at approximately 310° compensates for the arthritic condition of the hands and fingers of another golfer. Thus the present invention has once again created enjoyment from the art of putting and has made senior golfers more determined to master the game of golf since they now feel they can be competitive and will not lose "strokes" because of arthritis or other deformities in the hands and fingers.

Figure 4:
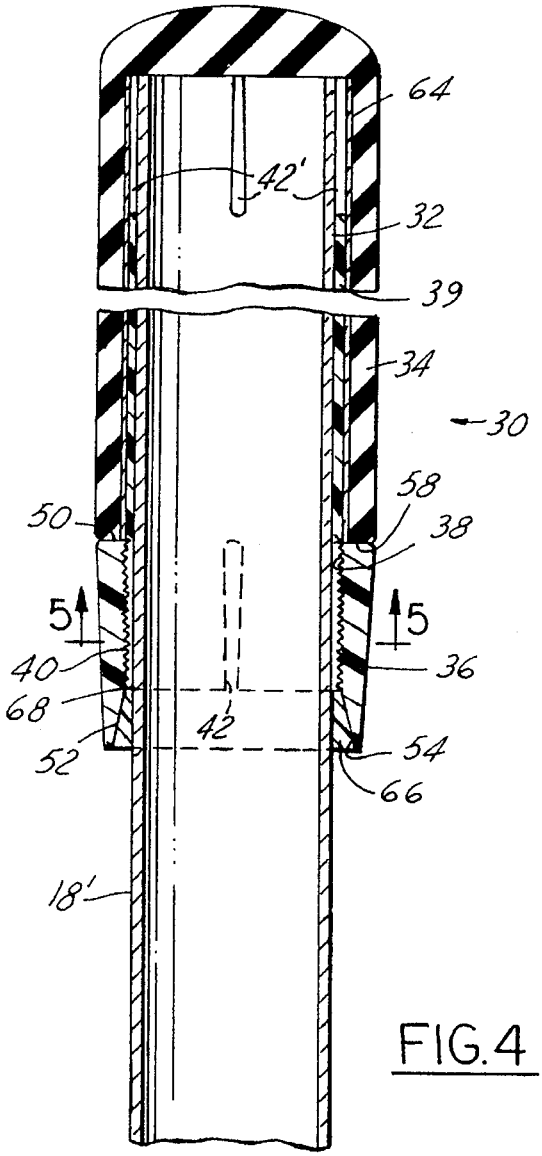
FIG. 4 is a fragmentary longitudinal sectional view taken on the line 4—4 of FIG. 2 and illustrating the securing of the hand grip assembly to the straight shaft after the adjustment thereof by means of a plastic sealant.
Figure 5:
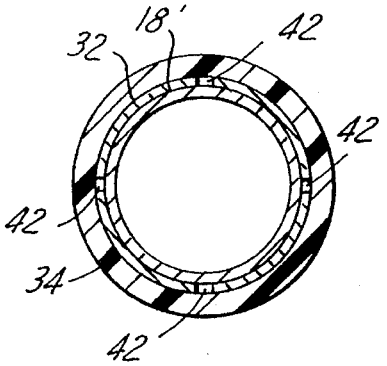
FIG. 5 is a sectional view taken on the line 5—5 of FIG. 4.

FIGS. 4 and 5 shows one embodiment of the present invention where the golf shaft 18' is straight from the hand grip end of the shaft to the other end. The shaft 18' is of tubular construction and is of generally circular cross section as shown in FIG. 5. The hand grip assembly is identified by the numeral 30 and includes a tubular sleeve 32, a resilient hand grip 34 and a retaining nut 36 which is internally threaded at 38. The retaining nut 36 is located on the externally threaded base or end portion 40 provided on the sleeve 32. The sleeve 32 is made from plastic or metal. It is tubular and has a smooth inner surface throughout its length. The inside diameter of the sleeve 32 is uniform throughout its length. The outer surface of the sleeve above the threaded base portion 40 is also smooth.

The sleeve 32 has a top or upper end portion 39 and a lower end or base portion 40 which is externally threaded. The sleeve 32 has a length of approximately ten (10) inches. The top portion 39 and the base portion 40 are each provided with four elongated, circumferentially spaced slots 42' and 42 respectively. The purpose of the slots 42 and 42' is to permit the top portion 39 and base portion 40 of the sleeve 32 to conform to the shaft 18. Thus the slots 42 and 42' permit the sleeve 32 to contract when necessary to conform to the shaft 18' after the nut 36 is tightened.

The retaining nut 36 has a flat annular upper surface 50 on the upper end and a lower radially extending tapered surface 52 which is spaced from the shaft 18' and defines therewith an annular groove 54. The annular groove 54 is below the sleeve 32. The nut 36 is made from plastic and has a height of approximately 1.25 inches. The nut 36 has an overhand of approximately ⅜ inch to form the radially extending tapered surface 52. The flat annular upper surface 50 of the retaining nut 36 faces the bottom annular surface 58 provided on the resilient hand grip 34. The hand grip 34 is made from rubber and is closed at one end and is open at the other end. In assembling the rubber grip 34 on the sleeve 32, a two-way or two-sided adhesive tape 64 is first wrapped around the sleeve 32 throughout its length. Thereafter the rubber grip 34 is sleeved over the sticky surface of the two-way tape 64. It takes about 45 minutes for the tape 64 to set.

In practice, the adjustable hand grip assembly 30 consisting of the tubular sleeve 32, tubular hand grip 34 and retaining nut 36 are sleeved over the shaft 18' after having first applied the two-way tape 64 to sleeve 32. The golfer rotatably adjusts the hand grip assembly 30 on the shaft 18'. Once the proper position is determined, the golfer tightens the nut 36 on sleeve 32 and thereafter places an epoxy resin or plastic sealant 66 in the annular groove 54 in order to immobilize the nut 36 and to fix the hand grip assembly 30 on the shaft 18' in the position determined by the golfer. The epoxy resin 66 secures the nut 36, end surface 68 on sleeve 32 and shaft 18' together.

Figure 6:
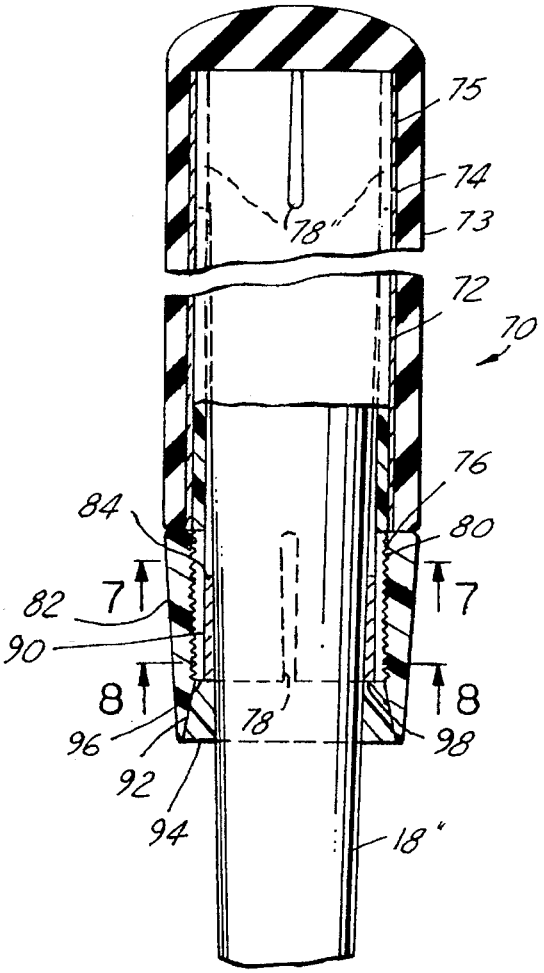
FIG. 6 is a fragmentary longitudinal sectional view of a modified golf putter, illustrating the rotatable hand grip assembly mounted on a tapered shaft, with a wedge interposed between the shaft and the threaded sleeve and the securing of the hand grip assembly to the tapered shaft after adjustment hereof by means of a plastic sealant.
Figure 7:
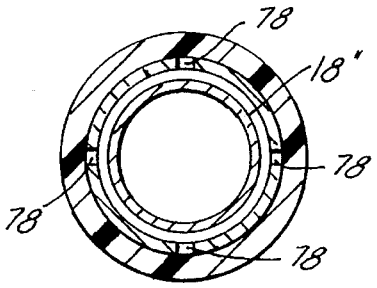
FIG. 7 is a sectional view taken on the line 7—7 of FIG. 6.
Figure 8:
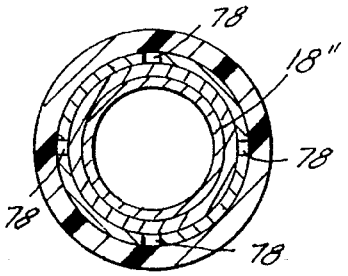
FIG. 8 is a sectional view taken on the line 8—8 of FIG. 6.

FIGS. 6–8 inclusive shows another embodiment of the present invention. The golf shaft 18" is tapered from the top towards the putter end of the shaft. The adjustable hand grip assembly 70 includes an elongated sleeve 72 having a top portion 74 and a lower or base portion 76. The sleeve 72 has a length of approximately ten (10) inches. The top portion 74 and base portion 76 of the sleeve 72 are each provided with four longitudinally extending, circumferentially spaced slots 78' and 78. The base portion 76 of the sleeve 72 is externally threaded at 80. A retaining nut 82 is threaded to the externally threaded base portion 76 and is designed to move longitudinally of the shaft.

In order to compensate for the tapered shaft 18" it is necessary to occupy some of the space 84 between the shaft tapered 18" and the sleeve 72 having a uniform inside diameter. This space 84 is of tapered configuration as viewed in FIG. 6. An annular wedge or wedge shape element 90 which is tapered axially is inserted into the space 84 between the shaft 18" and the base portion 76 of sleeve 72. As the retaining nut 82 is tightened on the sleeve 72, the nut 82 squeezes the base portion 76 to reduce the width of the slots 78 at the bottom of the nut 82. The base portion 76 squeezes the wedge 90 against the shaft 18" and assist in tightening the adjustable hand grip assembly on the shaft 18". Once the retaining nut 82 has been finally adjusted, it is immobilized by means of a plastic sealant such as an epoxy resin 94 as shown in FIG. 6. The epoxy resin 94 contacts the tapered surface 92 of retaining nut 82, the end surface 96 of the sleeve 72, the end surface 98 of the wedge 90 and the shaft 18". The slots 78' on the top portion 74 may also be reduced in width as the nut is tightened as shown in FIG. 6.

In assembling the rubber grip 73 of the assembly 70 on the tapered sleeve 72, a two-way or two-sided adhesive tape 75 is first wrapped around the sleeve 72 throughout its length. Thereafter the rubber grip 73 is sleeved over the sticky surface of the two-way tape 75.

Thus, a golf putter is provided which meets the physical and athletic needs of a golfer suffering from arthritis in the hands and fingers and which further meets the standards and rules of the United States Golf Association.

What I claim is:

1. A golf putter with an adjustable hand grip which is fixed in place by the golfer after final adjustment to accommodate the hands and fingers of the golfer which are arthritic or deformed comprising:

an elongated shaft having a pair of ends;

a head defining a flat putter face, said head being fixedly attached to one end of said shaft;

a hand grip assembly for the other end of said shaft, said assembly including an elongated tubular sleeve having a pair of end portions, with the exterior surface on one end portion being smooth and the exterior surface on the other end portion being threaded, a resilient hand grip closed at one end and open at the other end and surrounding said one end portion of said sleeve and an axially adjustable, internally threaded nut threadedly carried on the other end portion of said sleeve;

said elongated sleeve surrounding said other end of said shaft, with said other end portion having a plurality of longitudinally extending, circumferentially spaced slots to permit the other end portion of said sleeve to contact said shaft;

said resilient hand grip being located on and surrounding said one end portion of said sleeve, said hand grip having a flat annular bottom surface and a flat exterior spot on one side thereof which is normally located at a 90° angle to said putter face;

said adjustable nut being threadedly secured to the threaded end portion of said sleeve, said nut having a flat annular surface on one end thereof facing said flat annular bottom surface on said hand grip, said nut also having a surface on the other end thereof which is radially spaced from said shaft and forms with said shaft an annular groove, said nut being axially adjustable on said sleeve to urge said oppositely facing annular surfaces of said hand grip and nut together and thereby tighten said nut on said sleeve;

said hand grip assembly, prior to the golfer using the putter, being rotatable on said shaft to thereby locate said flat spot provided on said hand grip relative to said putter face at an angle other than 90° to customize said hand grip to fit the hands and fingers of the golfer which are arthritic or deformed;

said hand grip assembly after adjustment on said shaft to fit the hands and fingers of the golfer being fixedly attached to said shaft by means including a plastic sealant located within said annular groove to immobilize said nut and thereby fix said hand grip assembly on said shaft.

2. The golf putter defined in claim 1, wherein said angle is less than 90°.

3. The golf putter defined in claim 1, wherein said angle is more than 90°.

4. The golf putter defined in claim 1, wherein said angle is in the range of 0° to 360°.

5. The golf putter defined in claim 1, wherein said shaft is straight.

6. The golf putter defined in claim 1, wherein said shaft is tapered from said other end to said one end thereof.

7. The golf putter defined in claim 1, wherein said shaft is tapered, and a tapered wedge is located in and occupies the space between said shaft and said sleeve, said wedge being squeezed against said shaft by said nut when tightened on said sleeve.

8. The golf putter defined in claim 1 wherein said plastic sealant contacts said nut, sleeve and shaft.

9. The golf putter defined in claim 1, wherein said plastic sealant is formed from an epoxy resin.

10. The golf putter defined in claim 1, wherein there are four longitudinal slots which are equally spaced circumferentially apart and divides said other end portions into four elements which are squeezed by said nut as the nut is tightened on said sleeve.

11. The golf putter defined in claim 10, wherein said sleeve and said nut are made from plastic and said hand grip is made from rubber.

12. The golf putter defined in claim 11, wherein said shaft has an upper end, a lower end and is tapered, with the taper being wider at said upper end of the shaft then at the lower end of said shaft, said sleeve having a bore of uniform width throughout its length, said sleeve being spaced from said shaft, and a tapered wedge located in the space between said shaft and said sleeve, said wedge being squeezed against said shaft by said nut when tightened on said sleeve.

13. The golf putter defined in claim 12, wherein said wedge is made from a resilient material such as rubber or plastic.

* * * * *